United States Patent [19]

Willis

[11] 4,099,714

[45] Jul. 11, 1978

[54] FENCING GAME SET

[76] Inventor: Charles W. Willis, Rte. 1, Box 273, Rayle, Ga. 30660

[21] Appl. No.: 857,656

[22] Filed: Dec. 5, 1977

[51] Int. Cl.[2] ..... A63B 69/02

[52] U.S. Cl. ..... 273/1 F; 272/98

[58] Field of Search ..... 273/1 F; 272/98

[56] References Cited

U.S. PATENT DOCUMENTS

| | | | |
|---|---|---|---|
| 2,840,378 | 6/1958 | Harvey | 273/1 F |
| 3,128,097 | 4/1964 | La Rocca | 273/1 F X |

FOREIGN PATENT DOCUMENTS

| | | | |
|---|---|---|---|
| 568,216 | 12/1923 | France | 273/1 F |
| 297,054 | 3/1917 | Fed. Rep. of Germany | 273/1 F |

*Primary Examiner*—Paul E. Shapiro

*Attorney, Agent, or Firm*—Thomas N. Tarrant

[57] ABSTRACT

A fencing game set in which an apertured target supported from a base on a springy rod is interposed between duelists who simultaneously attempt to pierce the apertures and displace the target from the opponents aim. Score accumulators for each are mounted in the target base.

7 Claims, 2 Drawing Figures

FENCING GAME SET

BACKGROUND OF THE INVENTION

1. Field of the Invention

The present invention relates to fencing games and in particular to such games utilizing apertured targets.

2. Description of the Prior Art

Apertured targets have been made for a single person to use in practicing fencing skill. Both moving and stationary targets are known. Fencing involving a pair of opponents customarily uses the opponent as the target. This leads to a certain amount of hazard and the use of protective coverings frequently makes it difficult to tell where or even if a touch has been made.

SUMMARY OF THE INVENTION

According to the present invention a fencing game set uses a target supported from a base on a springy rod and carrying a plurality of apertures of graduated size. A pair of safety tipped epees are provided for manipulation from opposite sides of the target and two score accumulators are provided in the base, one for each side.

DESCRIPTION OF THE PREFERRED EMBODIMENT

The preferred construction of the present game set includes heavy base 10 which may be constructed of or use cast iron as a frame. Rod 11 of steel, fiberglass or similar durable springy material is mounted to the center of base 10. Vertical adjustment of rod 11 is sometimes desirable and can be provided by threading rod 11 into base 10 and providing a locknut such as wingnut 12 for locking rod 11 at a selected height. Some form of choke collar may be used to adjust height and a height adjuster can be provided at the target end of rod 11 instead of the base end.

Figure 1:
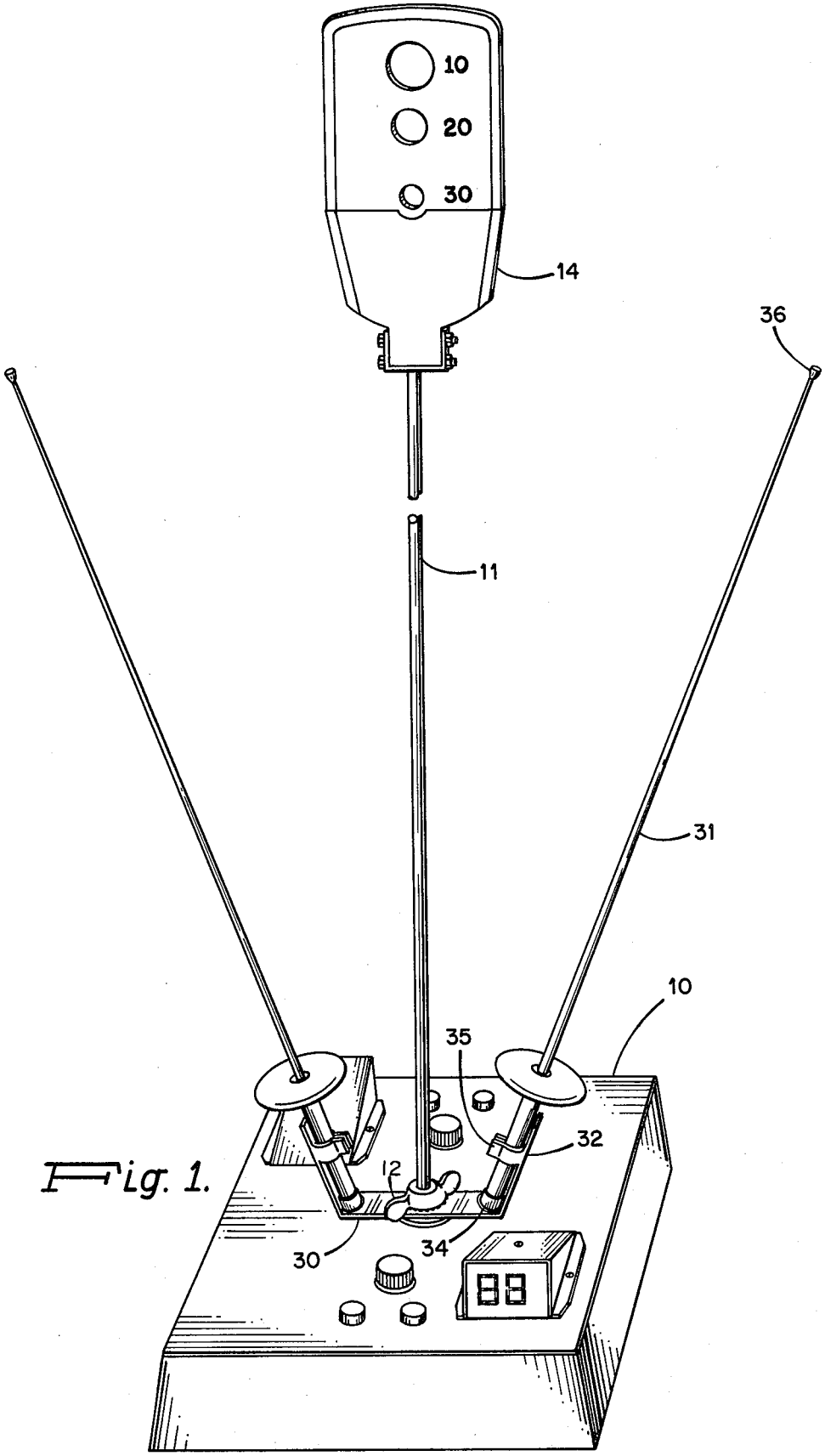
FIG. 1 is a perspective view of the complete game set of the invention.
Figure 2:
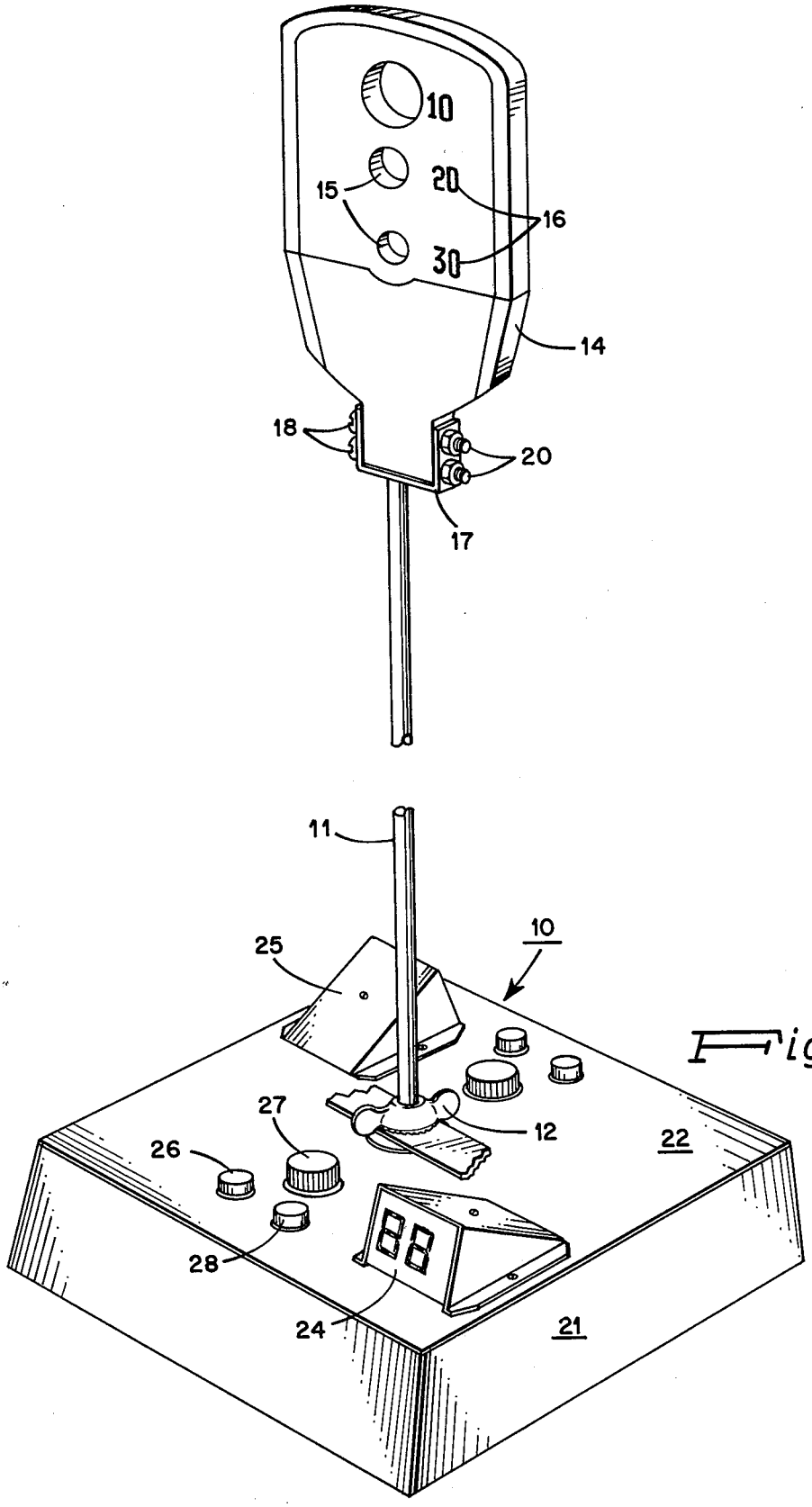
FIG. 2 is an expanded perspective of the base and target of FIG. 1.

Target 14 is suitably made of wood or plastic. It can be made with a mass relative to the length and flexibility of rod 11 so as to provide any desired oscillatory motion on being struck. A design that permits readily displacing the target with the tip of one of the swords used by 15 to 30 centimeters and will cause the target to oscillate noticeably thereafter for 3 to 8 seconds has been found satisfactory. Target 14 contains a plurality of apertures 15 in graduated sizes. A desirable arrangement, as depicted in FIGS. 1 and 2, has three apertures in vertical alignment with the largest at the top and the smallest at the bottom. The actual sizes are not critical as long as the smallest is large enough for the sword to enter. Score values 16 are designated beside respective apertures as 10, 20 and 30. However, the particular score values assigned are not critical to the game. Other aperture arrangements than that depicted may be used.

Rod 11 may be press-fit or cemented into an aperture in the bottom of target 14, it may be threaded into an aperture in the bottom of target 14, or it may be threaded, riveted or welded to a plate that is screwed or adhesively bonded to the bottom of target 14. As best depicted in FIG. 2, steel rod 11 is welded or brazed to metal strap 17 bent in a U-shape. Strap 17 is fitted over the bottom of target 14 and machine screws 18 are passed through strap 17 and target 14 and are secured with nuts 20.

Base 10 in the depicted embodiment is made with open iron frame 21 having a central cross-member (not shown) into which rod 11 is threaded. Cover plate 22 of plastic or sheet metal is adhesively bonded or screwed to frame 21. In FIG. 2, plate 22 is depicted as adhesively bonded sheet metal.

Score accumulators 24 and 25 depicted as digital readout displays are mounted to cover plate 22. Various scoring accumulators are contemplated. Calibrated slides, manually rotatable digital registers and various electronic devices may be used. The depicted accumulators 24 and 25 are light-emitting diode displays. Each display is driven by a circuit consisting of an oscillator, a counter and a decoder-driver. (This circuit is obvious and is not shown). Push On-Off switch 26 applies electric power from batteries or a suitable power supply. Potentiometer 27 controls the counting rate by varying the oscillator frequency and push switch 28 enables the counter to advance the display.

A counter for the score accumulators can readily be designed to advance by the minimum score amount, i.e. 10, at each operation of switch 28 reducing the chance of an overrun when the score advances continuously while the button is held as shown. In either case control 27 for counting speed is unnecessary and need not be included. Switches 26 and 28 are designed for push operation by sword tips to avoid the necessity for stooping. Character tubes, liquid crystal displays, gas plasma displays or mechanical registers can be utilized for the displays instead of the displays depicted.

Support stand 30 for epees (swords) 31 is secured centrally on cover plate 22. Stand 30 carries holders 32 for the handles of epees 31. Holders 32 are depicted as a socket 34 and clip 35 combination. An extended cylindrical socket will serve as well. As depicted, support stand 30 is secured in place by wingnut 12 which also locks rod 11.

The design of epees 31 is not critical to the invention, however a nonlethal configuration is preferred. Epees 31 may be made from wood, plastic or metal and are desirably tipped with rubber tips 36 or other safety tips.

A satisfactory game set has been made with the following specifications given by way of example.

EXAMPLE

Base 10; 30 cm. sq. by 10 cm. high Weight - 10 kgm (about 20 lbs)

Rod 11; Steel rod, 9 mm dia. by 108 cm. long

Target 14; Wood, 2 cm. thick by 12 cm. wide by 26 cm. high

Apertures 15; 3 cm. dia., 2.5 cm. dia. and 1.5 cm. dia., all with chamfered rims Epee 31; 9.5 mm. dia. by 86 cm. long A medium-carbon machine steel was used for rod 11 and target 14 weighed 1 kgm. (2.2 lbs).

While the invention has been described with respect to a specific embodiment, obvious variations are contemplated and it is the intention to cover the invention as set forth within the scope of the following claims.

We claim:

1. A fencing game set for two participants comprising:

a. a target having scoring apertures in graduated sizes;

b. a flexible rod supporting said target at upper torso height;

c. a base anchoring said rod;

d. two score tabulating devices mounted to said base; and, e. a pair of fencing foils for piercing said scoring apertures and knocking said target out of scoring position.

2. A fencing game set according to claim 1 wherein said scoring apertures are vertically aligned with their sizes decreasing toward the bottom.

3. A fencing game set according to claim 1 wherein the mass of said target is large enough with relation to the length and flexibility of said rod so as to oscillate for several seconds upon being struck.

4. A fencing game set according to claim 1 wherein said tabulating devices are electronic counters driving digital displays.

5. A fencing game set according to claim 4 wherein said electronic counters are advanced by buttons set in said base and operatable by the tips of said foils.

6. A fencing game set according to claim 1 wherein said base contains a cast iron frame for anchoring said target against blows struck during use.

7. A fencing game set according to claim 6 wherein said rod is adjustably threaded into said base whereby said target can be adjusted to the height of particular participants.

* * * * *